US009698527B2

(12) United States Patent
Chen

(10) Patent No.: US 9,698,527 B2
(45) Date of Patent: Jul. 4, 2017

(54) ELECTRICAL CONNECTOR HAVING A METALLIC REINFORCING MEMBER

(71) Applicant: FOXCONN INTERCONNECT TECHNOLOGY LIMITED, Grand Cayman (KY)

(72) Inventor: Ding-Cherng Chen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/222,977

(22) Filed: Jul. 29, 2016

(65) Prior Publication Data

US 2017/0033498 A1 Feb. 2, 2017

(30) Foreign Application Priority Data

Jul. 30, 2015 (TW) ..... 104124631 A

(51) Int. Cl.

| | |
|---|---|
| ***H01R 13/627*** | (2006.01) |
| ***H01R 13/631*** | (2006.01) |
| ***H01R 13/504*** | (2006.01) |
| ***H01R 13/41*** | (2006.01) |
| ***H01R 13/6581*** | (2011.01) |

(52) U.S. Cl.

CPC ..... *H01R 13/631* (2013.01); *H01R 13/41* (2013.01); *H01R 13/5045* (2013.01); *H01R 13/6275* (2013.01); *H01R 13/6581* (2013.01)

(58) Field of Classification Search

CPC ..... H01R 13/518; H01R 13/62905; H01R 13/62955; H01R 13/6721; H01R 13/6275; H01R 13/635; H01R 13/6392; H01R 13/648; H01R 13/681

USPC ..... 439/367, 368, 351, 352, 607.01

See application file for complete search history.

(56) References Cited

U.S. PATENT DOCUMENTS

| | | | | |
|---|---|---|---|---|
| 7,549,896 | B2 * | 6/2009 | Zhang | H01R 12/716 439/607.01 |
| 8,282,417 | B2 * | 10/2012 | Xiao | H01R 13/648 439/607.36 |
| 2009/0130876 | A1 * | 5/2009 | Nomiyama | H01R 13/6275 439/153 |
| 2011/0256764 | A1 * | 10/2011 | Wu | H01R 12/598 439/607.01 |
| 2014/0357124 | A1 * | 12/2014 | Zhao | H01R 13/405 439/607.55 |
| 2015/0200504 | A1 * | 7/2015 | Little | H01R 24/60 439/345 |
| 2015/0229077 | A1 * | 8/2015 | Little | H01R 13/6582 439/78 |

(Continued)

*Primary Examiner* — Chandrika Prasad

(74) *Attorney, Agent, or Firm* — Wei Te Chung; Ming Chieh Chang

(57) ABSTRACT

An electrical connector assembly includes: an insulative housing defining a receiving room; an arrangement module assembled on a rear end of the insulative housing and defining a riveting slot on a rear end thereof; a number of contacts retained in the receiving room and exposing to a rear end of the arrangement; a metal case enclosing the insulative housing and the arrangement module and having a riveting arm riveted into the riveting slot to fix the metal case on the insulative housing; and a reinforcing member assembled in the arrangement module and disposed near the riveting slot.

16 Claims, 6 Drawing Sheets

(56) References Cited

U.S. PATENT DOCUMENTS

2016/0141805 A1* 5/2016 Zhao ..... H01R 13/504
439/607.01

* cited by examiner

ELECTRICAL CONNECTOR HAVING A METALLIC REINFORCING MEMBER

BACKGROUND OF THE INVENTION

1. Field of the Invention

The present invention relates to an electrical connector assembly, and more particularly to an electrical connector assembly having a riveted metal case.

2. Description of Related Art

In the prior art, an electrical connector assembly includes a metal case for shielding effect. The metal case can be fixed on an insulative housing of the electrical connector by riveting.

U.S. Pat. No. 7,549,896 discloses a receptacle connector including a metal shield having a cover and a base and a dielectric housing having two blocks. The cover has a holding portion including two fingers correspondingly fixed by a slot between the two blocks.

An electrical connector assembly with improved riveted metal case is desired.

BRIEF SUMMARY OF THE INVENTION

Accordingly, an object of the present invention is to provide an electrical connector assembly having an improved riveted metal case.

In order to achieve the above-mentioned object, an electrical connector assembly in accordance with the present invention comprises: an insulative housing defining a receiving room, an arrangement module assembled on a rear end of the insulative housing and defining a riveting slot on a rear end thereof, a plurality of contacts retained in the receiving room and exposing to a rear end of the arrangement, a metal case enclosing the insulative housing and the arrangement module and defining a riveting arm riveted into the riveting slot to fix the metal case on the insulative housing, and a reinforcing member assembled in the arrangement module and disposed near the riveting slot.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
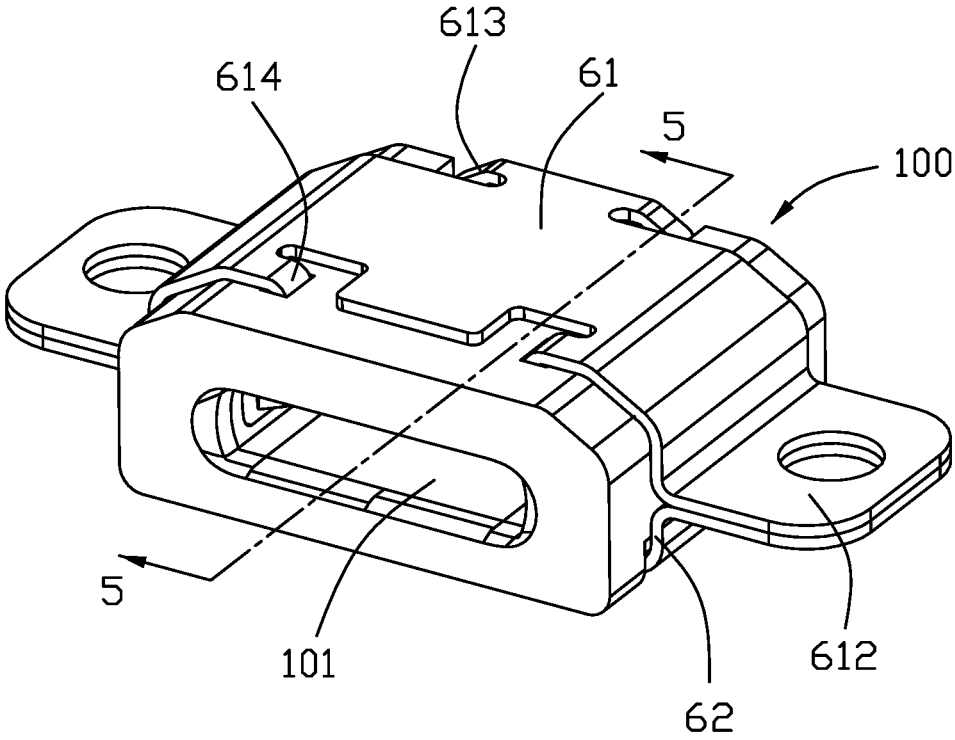
FIG. 1 is a perspective view of an electrical connector assembly according to the present invention.
Figure 2:
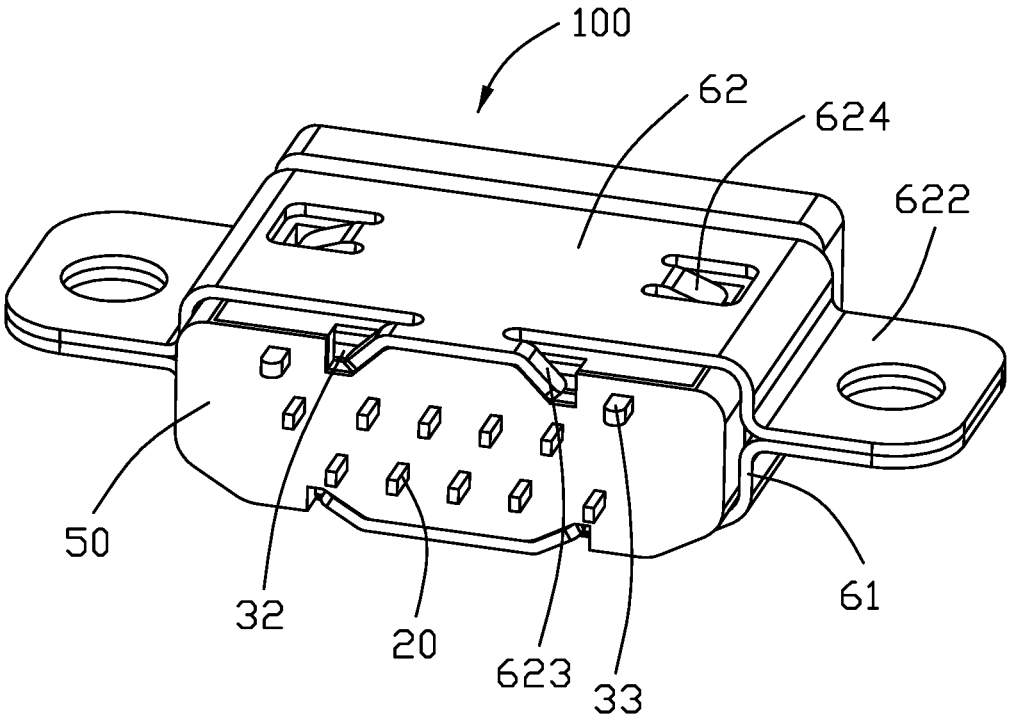
FIG. 2 is an perspective view similar to the FIG. 1, but from different perspective.

Referring to FIGS. 1-4, a electrical connector assembly 100 in accordance with the present invention comprises an insulative housing 10, a plurality of contacts 20 retained in the insulative housing 10, a latch 30, an arrangement module assembled on a rear end of the insulative housing 10 to arrange the contacts 20, and a metal case 60 enclosing the insulative housing 10 and the arrangement module. The arrangement module includes a spacer 40 assembled on a rear end of the insulative housing 10 and a cover member 50 covering a rear end of the spacer 40.

Figure 3:
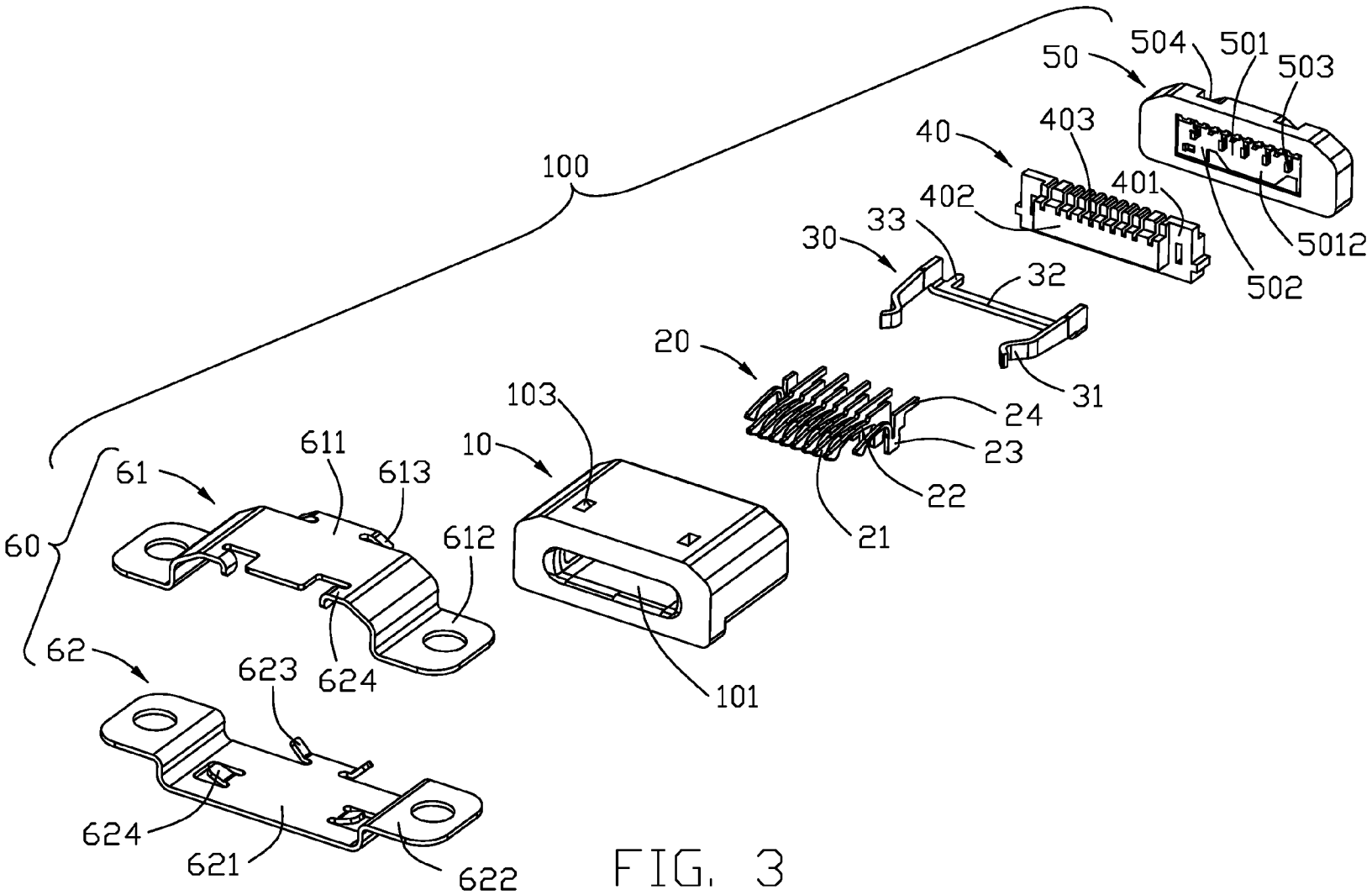
FIG. 3 is an exploded view of the electrical connector assembly shown in FIG. 1.
Figure 4:
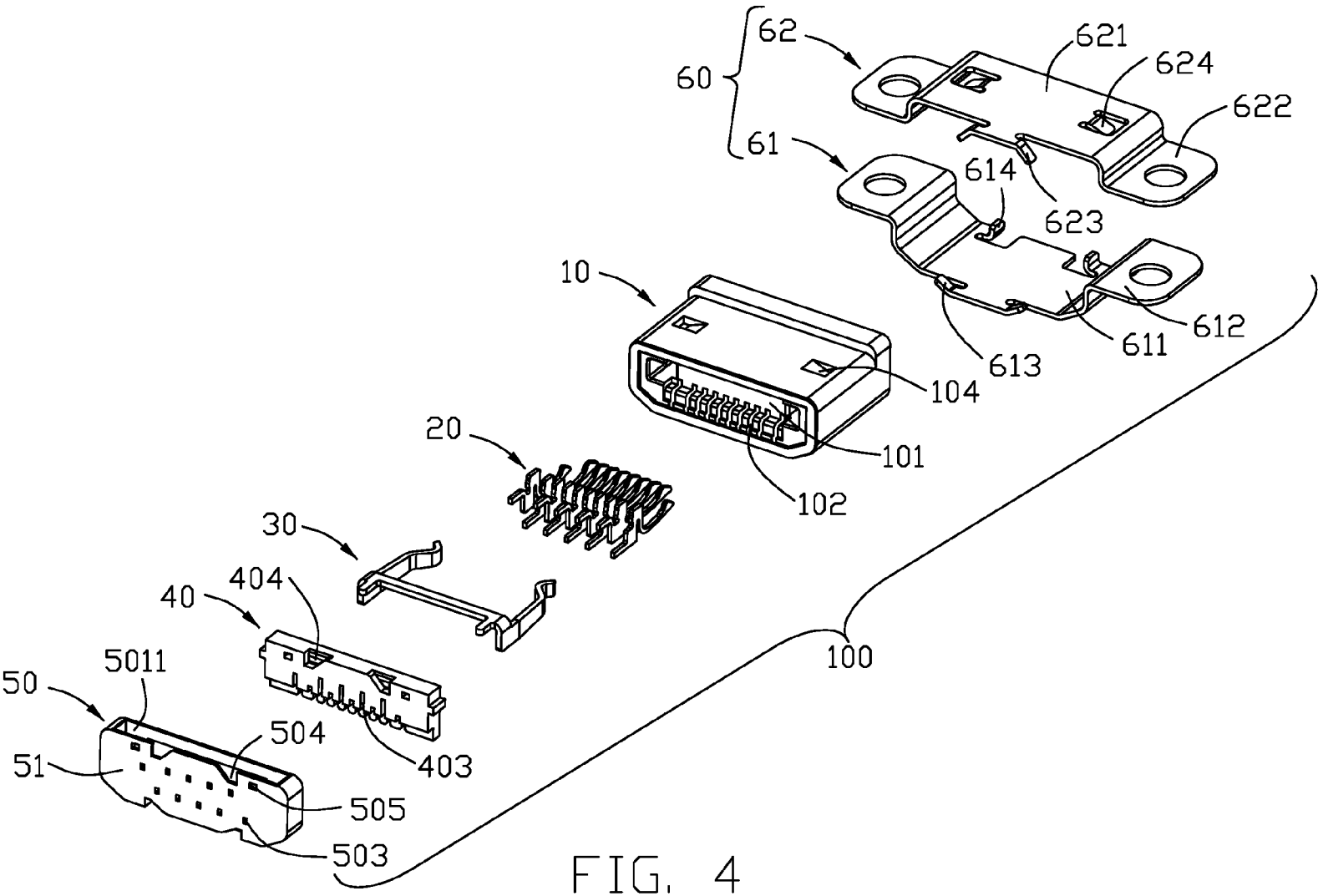
FIG. 4 is an exploded view similar to FIG. 3, but from different perspective.

Referring to FIGS. 3 and 4, the insulative housing 10 defines a receiving room 101 through a front surface for receiving a mating plug (not shown) and a rear surface thereof, for receiving the contacts 20 and the latch 30. The insulative housing 10 defines a plurality of fixing slots 102 on a rear side of the receiving room 101.

Figure 5:
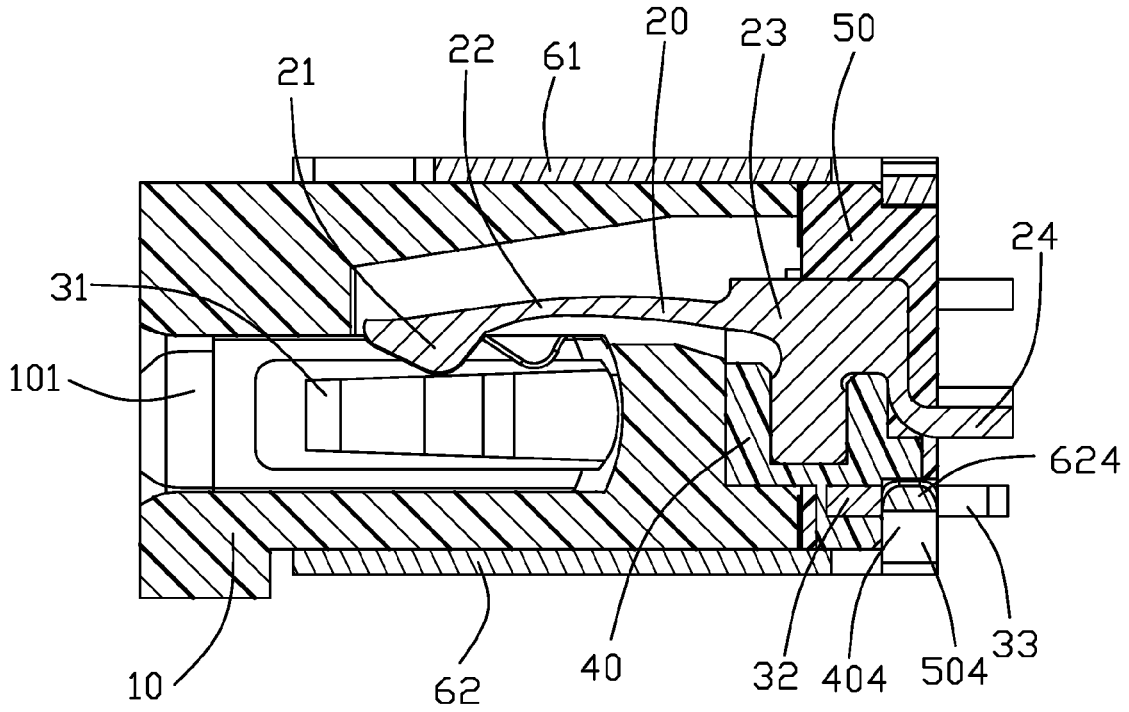
FIG. 5 is a cross-sectional view of the electrical connector assembly in FIG. 1 along line 5-5.

Referring to FIGS. 3-5, the spacer 40 is essentially of a rectangular block, including a base portion 401, an extension portion 402 extending from the base portion 401, and a plurality of receiving slots 403 defined on a top end of the spacer 40. The receiving slots 403 extend through the base portion 401 and the extension portion 402. A spacing portion is formed between every two adjacent receiving slots 403. The extension portion 402 is inserted into a rear end of the receiving room 101 of the insulative housing 10 and the spacing portions are inserted into corresponding fixing slots 102 and fixed therein. The base portion 401 defines two pairs of mounting slots 404 on a bottom end thereof.

Referring to FIGS. 3-5, the cover member 50 is essentially of a rectangular block, made of insulating material and including a body portion 501. The body portion 501 defines an accommodating room 502 therein, which downwardly extends through a bottom surface of the body portion 501 to form a bottom opening 5011 and forwardly extends through a front surface of the body portion 501 to form a front opening 5012. The body portion further defines a plurality of through holes 503 communicating with the accommodating room 502 through a rear end thereof. The body portion 501 defines two pairs of riveting slots 504 on a rear end thereof. The base portion 401 of the spacer 40 is received in the accommodating room 502. The bottom end of the base portion 401 exposes to the bottom end of the cover member 50 through the bottom opening 5011, the pair of mounting slots 404 aligned to one of the pair of riveting slots 504 on a bottom end of the cover member 50. The body portion 501 of the cover member 50 further defines a pair of grounding through holes 505 communicating with the accommodating room 502 through the rear end thereof.

Referring to FIGS. 2-5, each of the contacts 20 defines a connecting portion 22, a contacting portion 21 forwardly extending from the connecting portion 22 for mating with a mating connector, a mounting portion 23 rearwardly extending from the connecting portion 22 and received in the corresponding receiving slot 403, and a soldering portion 24 rearwardly extending from the mounting portion 23 through the corresponding slots 403 and the through holes 503 to expose to the rear end of the cover member 50.

Referring to FIGS. 3-5, the latch 30 defines a pair of latch arms 31, a reinforcing portion/reinforcing member 32 connecting two opposite ends of the pair of latch arms 31 and a pair of grounding sheets/legs 33 rearwardly extending from two opposites sides of the reinforcing portion/reinforcing member 32 respectively.

Figure 6:
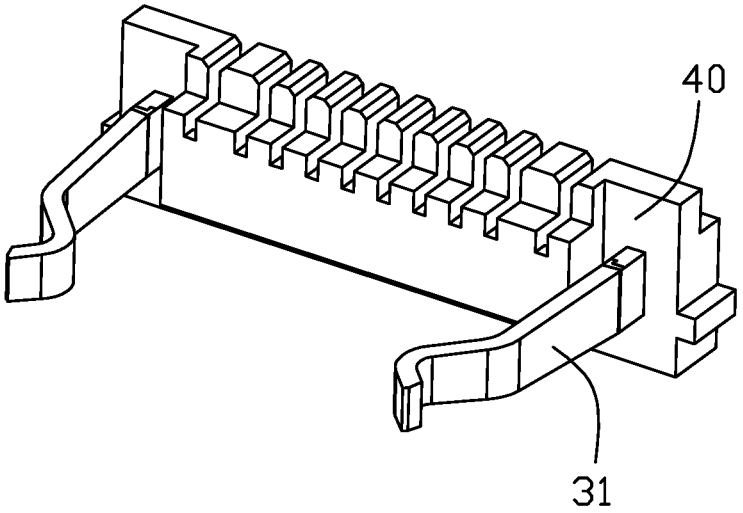
FIG. 6 is a perspective view of the spacer and the latch of the electrical connector assembly shown in FIG. 1.

Referring to FIGS. 5 and 6, the latch 30 is integrally assembled in the spacer 40 at the time of injection molding, i.e., an insert-molding process, the reinforcing portion/reinforcing member 32 extending along a horizontal direction from left to right in the base portion 401 of the spacer 40, the latch arms 31 through the base portion 401 to expose to the front end of the spacer 40, the grounding sheets 33 through the base portion 401 to expose to the rear end of the spacer 40. The spacer 40 is assembled on the rear end of the insulative housing 10, the latch arms 31 of the latch 30 received in the receiving room 101, the grounding sheets 33 through the grounding through holes 505 of the body portion 501 of the cover member 50 to expose to the rear end of the cover member 50.

In other embodiment, the reinforcing portion/reinforcing member 32 can be defined separately with the latch 30, and be fixed in the cover member 50 or spacer 40 by fixing manner, such as mosaic, assembled, etc, to ensure the fixed position of the reinforcing portion/reinforcing member 32 in peripheral position of the riveting slots 504 to, strengthening the strength of a portion of the arrangement module located on a front side of the riveting slots 504.

Referring to FIGS. 1-4, the metal case 60 includes a first case 61 covering a top side of the insulative housing 10, and a second case 62 covering a bottom side of the insulative housing 10. The first case 61 includes a main body 611 being of sheet, a pair of flange portions 612 extending from two opposite sides of the main body 611 respectively. The main body 611 defines a pair of riveting arms 613 on a rear end thereof. The main body 611 defines a pair of fixing arms 614 on a front end thereof by punching. The insulative housing 10 defines a pair of fixing grooves 103, into which the pair of fixing arms 614 are inserted. The riveting arms 613 are riveted into the corresponding riveting slots 504 of the cover member 50 disposed on a top side. The second case 62 includes a main body 621 being of sheet, a pair of flange portions 622 extending from two opposite sides of the main body 621 respectively. The main body 621 defines a pair of riveting arms 623 on a rear end thereof. The main body 611 defines a pair of fixing arms 624 on a front end thereof by punching. The insulative housing 10 defines a pair of fixing grooves 104, into which the pair of fixing arms 624 are inserted. The riveting arms 623 are riveted into the corresponding riveting slots 504 of the cover member 50 disposed on a bottom side.

Referring to FIGS. 2-5, the reinforcing portion/reinforcing member 32 of the latch 30 are assembled or molded integrally with the spacer 40 when injecting, to enhance the strength of the spacer 40, and then avoiding spacer 40 being destroyed when the riveting arms 623 are riveted into the corresponding riveting slots 504, reducing the probability of failure of riveting. Simultaneously, the reinforcing portion/reinforcing member 32 electrically contacts with the riveting arms 623, strengthening grounding and shielding effect of the electrically connector assembly 100.

In assembling, the latch 30 is firstly assembled in the spacer 40 at the time of injection molding, the reinforcing portion/reinforcing member 32 extending along a horizontal direction from left to right in the base portion 401 of the spacer 40 approaching to the mounting slots 404 and exposing in the mounting slots 404, the latch arms 31 extending through the base portion 401 to expose to the front end of the spacer 40, the grounding sheets 33 extending through the base portion 401 to expose to the rear end of the spacer 40. The mounting portions 23 of the contacts 20 are inserted into the corresponding receiving slot 403, the soldering portions 24 exposing to the base portion 401. The base portion 401 of the spacer 40 is then received in the accommodating room 502 of the cover member 50, the bottom end of the base portion 401 exposing to the bottom end of the cover member 50 through the bottom opening 5011, the pair of mounting slots 404 aligned to the pair of riveting slots 504 on a bottom end of the cover member 50, the grounding sheets 33 passing through the grounding through holes 505 of the body portion 501 of the cover member 50 to expose to the rear end of the cover member 50, the soldering portions 24 of the contacts 20 passing through the through holes 503 of the cover member 50 to expose to the rear end of the cover member 50. The extension portion 402 of the spacer 40 is inserted into a rear end of the receiving room 101 of the insulative housing 10 and the spacing portions are therefore inserted into the corresponding fixing slots 102 and fixed therein, thus assembling the spacer 40 to the rear end of the insulative housing 10, with the latch arms 31 of the latch 30 and the contacting portions 21 of the contacts 20 being received in the receiving room 101. The first case 61 and the second case 62 of the metal case 60 are engaged together to enclose the insulative housing 10 and the cover member 50, the pairs of fixing arms 614 of the metal case 60 being inserted into the corresponding fixing grooves 103 of the insulative housing 10, the pairs of riveting arms 613 of the metal case 60 being riveted into the corresponding riveting slots 504 of the cover member 50, and a pair of riveting arms 613 electrically contacting with the reinforcing portion/reinforcing member 32 which is exposed to the mounting slots 404 and corresponding riveting slots 504. From a technical viewpoint, the mounting slots 44 also perform the riveting slots 54 function, i.e., receiving the riveting arm 613. Also, from a technical viewpoint, the confrontation between the riveting arm 613 and the reinforcing member 30 in a front-to-back direction is essentially of an edge-to-edge manner, i.e., an edge of a plane defined by the riveting arm 613 confronting another edge of another plane defined by the reinforcing member 30, disregarding said confrontation is of a single point or a while line defined by those edges.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector assembly comprising:

an insulative housing, defining a receiving room;

an arrangement module assembled on a rear end of the insulative housing, the arrangement module defining a riveting slot on a rear end thereof;

a plurality of contacts retained in the receiving room and exposing to the rear end of the arrangement module;

a metal case enclosing the insulative housing and the arrangement module, the metal case having a riveting arm riveted into the riveting slot to fix the metal case on the insulative housing; and a reinforcing member assembled in the arrangement module and disposed close to the riveting slot.

2. The electrical connector assembly as recited in claim 1, wherein the reinforcing member is insert-molded in the arrangement module.

3. The electrical connector assembly as recited in claim 2, wherein the reinforcing member extends along a horizontal direction from left to right in the arrangement module.

4. The electrical connector assembly as recited in claim 3, wherein the reinforcing member is made of metallic material.

5. The electrical connector assembly as recited in claim 4, wherein a portion of the reinforcing member is exposed to the riveting slot to electrically contact with the riveting aim.

6. The electrical connector assembly as recited in claim 5, further comprising a latch including a pair of latch arms received in the receiving room, and wherein the reinforcing member extends between the latch arms.

7. The electrical connector assembly as recited in claim 6, wherein a rear sidewall of the reinforcing member is exposed to the riveting slot.

8. The electrical connector assembly as recited in claim 7, wherein the latch defines a grounding arm rearwardly extending to expose to the rear end of the arrangement module.

9. The electrical connector assembly as recited in claim 5, wherein the arrangement module includes a spacer and a covering member covering the spacer, and the reinforcing member is assembled in the spacer.

10. The electrical connector assembly as recited in claim 9, wherein the metal case has a fixing arm, and the insulative housing has a fixing groove receiving the fixing arm.

11. An electrical connector comprising:

an insulative housing defining a receiving room forwardly communicating with an exterior along a front-to-back direction for receiving a complementary plug connector;

a plurality of terminals disposed in the housing with contacting sections exposed in the receiving room;

a metallic reinforcing member located behind the receiving room and located in a fixed position with regard to the housing in a front-to-back direction;

a metallic shell enclosing the housing with a fixed relation therebetween;

wherein said shell forms a riveting arm extending in a plane perpendicular to a vertical plane which is perpendicular to said front-to-back direction, and said riveting arm forwardly abuts against the said reinforcing member in said front-to-back direction.

12. The electrical connector as claimed in claim 11, wherein said reinforcing member is bound in an insulative spacer attached to a rear side of the housing.

13. The electrical connector as claimed in claim 12, wherein said spacer forms a riveting slot in which said riveting arm is received and to which said reinforcing member is intimately exposed rearwardly.

14. The electrical connector as claimed in claim 12, wherein said reinforcing member includes a grounding leg, and said terminals include corresponding tails, and both said grounding leg and said tails are exposed behind the spacer.

15. The electrical connector as claimed in claim 12, wherein a front portion of the spacer is received within a rear portion of the receiving room around said rear side of the housing, and a rear portion of the spacer is rearwardly exposed outside of the housing in said front-to-back direction.

16. The electrical connector as claimed in claim 11, where said reinforcing member further includes a pair of latching arms extending into two opposite lateral sides of the receiving room.

* * * * *